United States Patent [19]

Frappe

[11] 3,944,134

[45] Mar. 16, 1976

[54] PUNCHING MACHINE FOR CARDS OR PAPER BANDS TO BE USED FOR THE CONTROL OF JACQUARDS, DOBBIES AND THE LIKE

[75] Inventor: Pierre Frappe, Lyon, France

[73] Assignee: Verdol S.A., Caluire, France

[22] Filed: Oct. 10, 1974

[21] Appl. No.: 513,892

[30] Foreign Application Priority Data

Oct. 29, 1973 France ..... 73.39274

[52] U.S. Cl. ..... 234/111; 234/85

[51] Int. Cl.[2] ..... G06K 1/08; D03C 17/00

[58] Field of Search ..... 234/111, 117, 114–116, 234/85, 54, 56

[56] References Cited

UNITED STATES PATENTS

| | | | |
|---|---|---|---|
| 2,552,942 | 5/1951 | Dalle | 234/85 X |
| 2,741,312 | 4/1956 | Johnson | 234/56 |
| 2,745,494 | 5/1956 | Boettcher | 234/85 |
| 3,090,550 | 5/1963 | Servillat | 234/111 X |
| 3,516,601 | 6/1970 | Behrens | 234/117 X |

*Primary Examiner*—J. M. Meister

*Attorney, Agent, or Firm*—Dowell & Dowell

[57] ABSTRACT

A punching machine for the cards or paper bands used in jacquards, dobbies and the like, comprises horizontal punches individually actuated by pusher means through presser rods which may be selectively brought to an ineffective oblique position. Each presser rod is attached to a needle itself attached by its upper end to a vertical rod. All these vertical rods are alternately raised and permitted to return downwardly so as to reciprocate in front of individual electromagnets which are selectively energized to retain some of the said vertical rods at their raised position. The vertical rods are disposed in successive longitudinal rows and the electromagnets are arranged in corresponding superposed horizontal elongated banks, the vertical rods of each row terminating upwardly short of the next bank of electromagnets in order not to interfere with them. The electromagnets are of the U-shaped type with the poles one above the other at a quite short distance from the rods, in order that each rod may be attracted and retained frictionally by its corresponding electromagnet.

5 Claims, 6 Drawing Figures

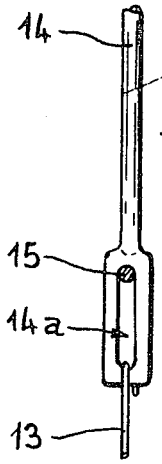
Fig. 2
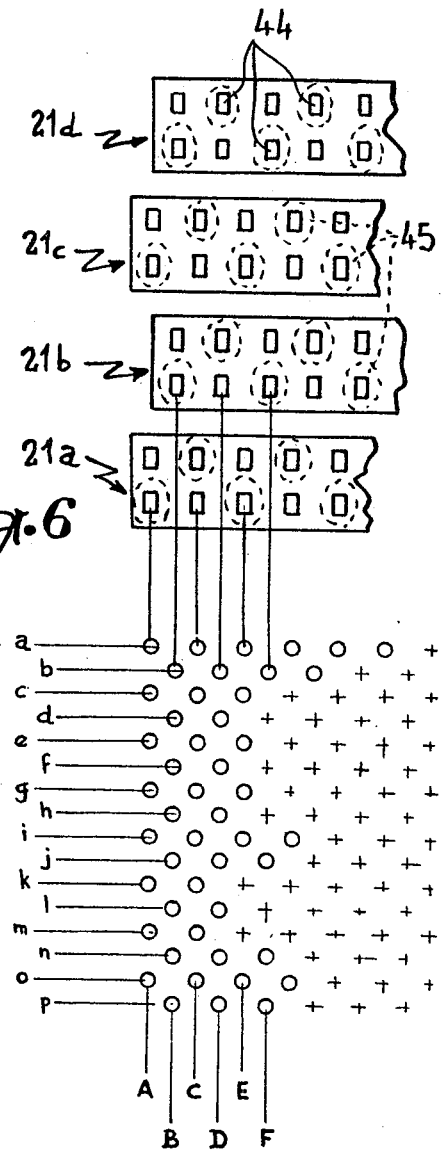
Fig. 6
Fig. 5
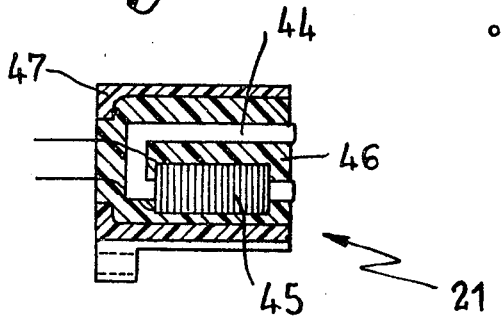

PUNCHING MACHINE FOR CARDS OR PAPER BANDS TO BE USED FOR THE CONTROL OF JACQUARDS, DOBBIES AND THE LIKE

This invention relates to the punching of the cards or paper bands for loom jacquards.

It is known that these cards or paper bands are preforated or punched in accordance with the design which should appear on the fabric. For this purpose, punching machines have been deviced which were actuated by an operator who "read-in" the successive horizontal lines of a colored drawing prepared on squared paper. More recently photo-electric devices have been imagined which effect automatically the selective detection or "reading-in" of the colors, while appropriate circuits combine the signals from these devices with those which result from the ground weave to electrically control the punching machine.

It is an object of the present invention to provide such a punching machine adapted to be controlled either directly by the photo-electric reading-in devices, appropriate cards then supplying the ground weave, or by appropriate circuits which combine the ground weave with the signals received from the photo-electric devices.

The machine according to the invention makes use of the known presser needle system of the Verdol jacquard for actuating the perforating punches, the feeler needles associated with the pusher needles being alternately raised and lowered at the reading-in rate, while their selection is effected by means of electromagnets adapted to retain at the "raised" position rods associated with these feeler needles, and also, if necessary, by a perforated card or paper band which the said feeler needles are caused to engage.

In the annexed drawings;

FIG. 2 is an enlarged detail view showing the lower eyelet of a selecting rod with the upper end of the corresponding feeler needle.

FIG. 5 is an enlarged detail section illustrating one of the electromagnets of the retaining block.

FIG. 6 is a diagram showing the arrangement of the perforations in the lower cross member and its correspondence with the first series of electromagnets on one side of the machine.

Figure 1:
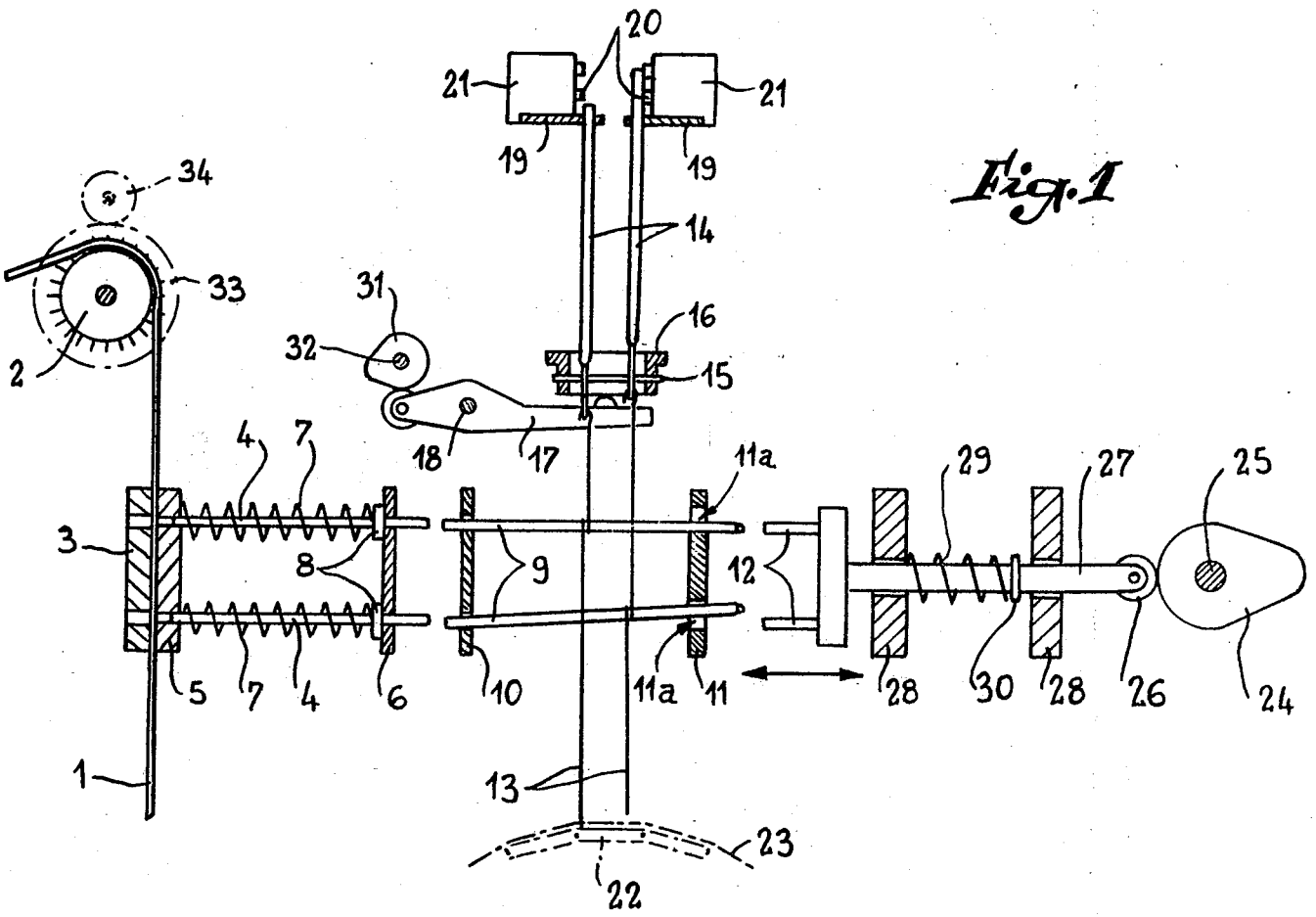
FIG. 1 is a diagrammatical view illustrating the main parts of a punching machine according to the invention and their operation.

Referring to FIG. 1, the paper band 1 to be perforated is displaced vertically by a pegged cylinder 2 and is thus caused to slide in front of a perforating die 3 adapted to cooperate with punches 4 (two only of which have been illustrated) which are guided by a counter-die plate 5 and by a perforated guiding plate 6. A spring 7 mounted on each punch 4 acts on an abutment 8 secured to the punch to bias the latter towards its retracted position with respect to die 3. Each punch 4 is actuated by a presser rod 9 which is guided with a reduced clearance by a first perforated guiding plate 10 situated adjacent the end of punches 4 remote from die 3, and with a considerable clearance in the vertical direction by a second guiding plate 11 disposed near the other end of the said rods, the said plate 11 having for this purpose vertically elongated perforations 11*a*. At its operative position, each presser rod 9 rests against the lower end of the corresponding perforation 11*a* of the guiding plate 11 under the effect of its own weight and it is thus in the alignment of the corresponding punch 4. If on the contrary the end of the presser rod situated near guiding plate 11 is raised, this pusher rod assumes a somewhat oblique position. Pushers 12 are disposed in front of the ends of presser rods 9 opposed to punches 4, these pushers having a horizontal reciprocating motion in synchronism with the intermittent advance of the paper band 1 in such manner as only to act on the presser rods when the said band is at standstill in front of the die 3. Pushers 12 are arranged in order to be situated in front of the presser rods 9 which are "low", i.e. which rest on the lower end of the corresponding perforations 11*a*, while they are ineffective for those of the said presser rods which have been raised.

A feeler needle 13 is attached to each presser rod 9 in the vicinity of guiding plate 11. Each feeler needle 13 has a hook-shaped upper end (see also FIG. 2) which is passed through an elongated opening 14*a* provided in the flattened lower end of a retaining rod 14 made of iron or soft steel. Rods 14 are disposed in successive rows and a transverse bar 15 is passed through the openings 14*a* of the rods of each row, these bars being supported by a vertically movable frame 16. In the diagrammatical embodiment of FIG. 1 frame 16 is shown as actuated by a lever 17 pivoted at 18 and driven in any appropriate manner. The upper end of each rod 14 passes through a guiding plate 19 and in front of the ends of the fixed core 20 of an individual electromagnet 21.

Of course in actual practice the number of punches, presser rods, pushers, feeler needles, retaining rods and electromagnets is equal to the number of holes which may be punched in one card of the paper band 1.

The operation is as follows:

Pushers 12 being at their retracted or ineffective position (towards the right in FIG. 1), feeler needles 13, retaining rods 14 being at their lowered position, and punches 4 being retracted under the action of their springs 7, the paper band 1 is advanced from one card to the next one. At the same time frame 16 is raised in order that bars 15 may raise all the retaining rods 14 together with feeler needles 13 and presser rods 9. The appropriate electric signals are then selectively applied to the individual electromagnets 21. Those of the latter which are thus energized attract the corresponding retaining rods 14 which thus engage their cores 20.

Frame 16 is then lowered. The retaining rods 14 which do not correspond to energized electromagnets are thus also lowered together with the corresponding pusher rods 9, while on the contrary the retaining rods 14 corresponding to energized electromagnets remain at their "raised" position, whereby selection of the presser rods is effected.

Pushers 12 are then advanced and they selectively actuate the lowered presser rods 9, and the corresponding punches 4 thus perforate the paper band 1.

For the case wherein the signals applied to the electromagnets would not take into account the ground weave, the machine further comprises a perforated table 22 on which may slide a paper band 23 pre-perforated in correspondence with that weave. It will be understood that those of the feeler needles which will meet an unperforated portion of band 23 will then remain at the raised position even if there retaining rods 14 are not retained by their electromagnets 21.

Pushers 12 may be driven in any appropriate manner. In FIG. 1 there has been shown for this purpose a cam 24 mounted on a shaft 25 conveniently connected with the driving shaft of the machine, the said cam acting on a roller 26 mounted on the end of a rod 27 which slides in guides 28 which terminates into a head to which pushers 12 are secured. A spring 29 acting on an abutment 30 urges roller 26 against cam 24. Of course, there is provided at least another rod 27 to positively guide pushers 12. In order to ensure a satisfactory centering between these pushers and the presser rods the ends of the presser rods (or respectively those of the pushers) may be conical while those of the pushers (or respectively of the presser rods) are formed with a corresponding depression.

Lever 17 may also be actuated by a cam such as 31 mounted on a shaft 32 connected with the driving shaft of the machine.

Finally the pegged wheel 2 may be driven by a gear 33 which meshes with a pinion 34 itself driven from the driving shaft of the machine through a Geneva cross mechanism in the per se known manner.

FIGS. 2 to 5 illustrate the general construction of the above described system including the feeler needles 13, the retaining rods 14 and the electromagnets 21.

Figure 3:
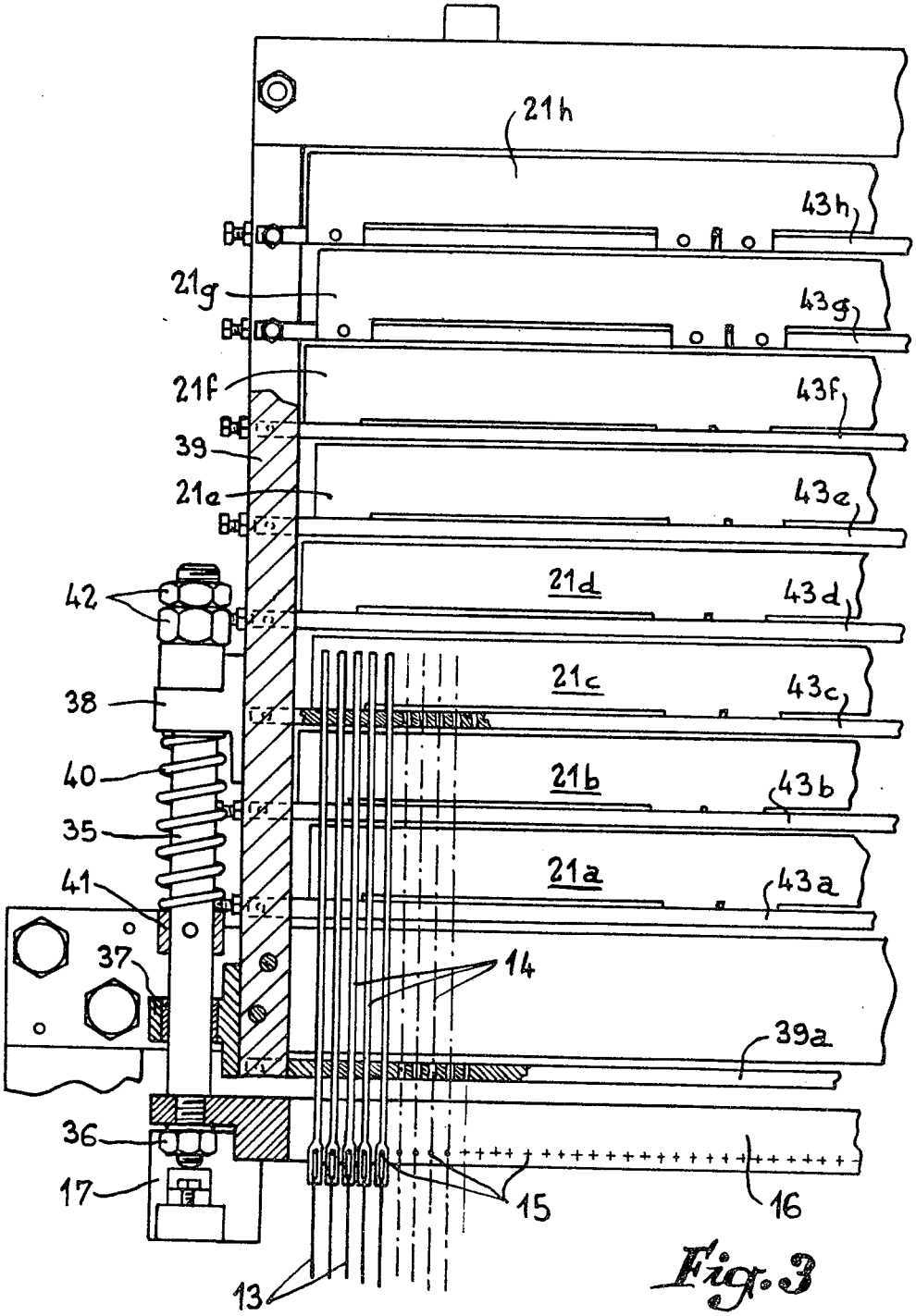
FIG. 3 is a longitudinal section of that portion of the machine which includes the selecting rods and the electromagnets associated therewith.
Figure 4:
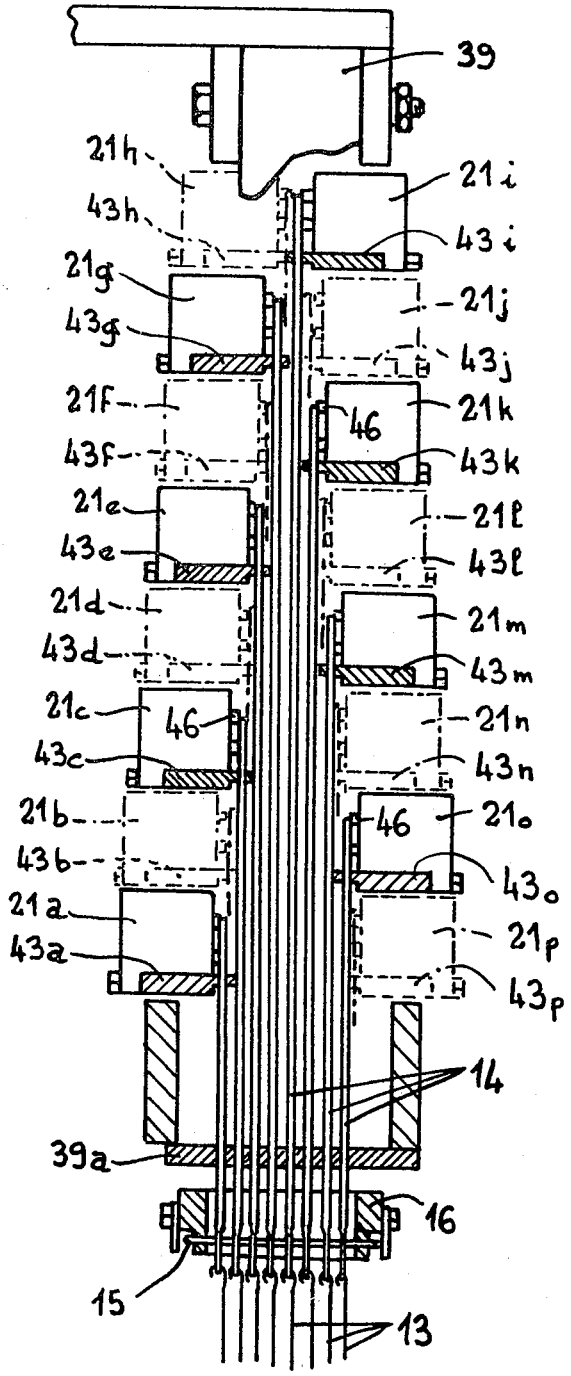
FIG. 4 is a transverse section of this portion.

As above mentioned, FIG. 2 shows to an enlarged scale a bar 15 disposed within the elongated lower eyelet 14a of a retaining rod 14. It will be noted that the corresponding feeler needle 13, practically made of steel wire of reduced diameter, is merely hooked to the lower portion of the eyelet. Referring to FIGS. 3 and 4, the reciprocatable frame 16 supports the bars corresponding to all the retaining rods of the machine. As shown these rods are disposed in successive transverse rows of eight rods each, a bar 15 passing through the eyelets of all the rods of each row. Each end of frame 16 is secured to a column 35 by means of a nut 36, this column sliding in guides 37 and 38 carried by a stationary frame 39. A spring 40 takes rest against the guide 38 and against a ring 41 keyed to the column and it thus urges downwardly the reciprocatable frame 16, this descending stroke being limited by a nut and counter-nut unit 42 screwed on the upper end of each column and which engages the upper guide 38. FIG. 3 further shows one of the oscillating levers 17 which reciprocate frame 16 as diagrammatically illustrated in FIG. 1.

The stationary frame 39 is of general rectangular shape, its flat lower cross-member 39*a* being perforated to ensure the guiding of the retaining rods 14. Above cross-member 39*a* frame 39 comprises a number of superposed pairs of other cross-member 43*a*–43*p*, 43*b*–43*o*, 43*c*–43*n*, etc . . . , the cross-members of each pair, disposed in the same horizontal plane, leaving between them a space for passage of the retaining rods 14 which extends upwardly above their level. As shown each cross-member such as 43*a*, has along its edge which faces the retaining rods 14 a marginal extension of reduced thickness which is perforated for passage of a longitudinal row of these rods 14, this extension thus being the equivalent of the perforated guide 19 of FIG. 1. Each cross-member 43 carries an elongated block formed of a row of electromagnets 21, each comprising a U-shaped core 44 (FIG. 5) the branches of which are superposed in a transverse vertical plane. One of these branches supports a spool 45, the said spool being alternately mounted on the upper branch and on the lower one in the succession of electromagnets which may thus be disposed close to each other along the row. All the electromagnets of the row are embedded in a mass 46 of an appropriate plastic material within a metallic casing 48 to form therewith a single block which extends almost across the full width of frame 39 between the lateral uprights thereof, their poles projecting outwardly towards retaining rods 14.

For a clear understanding of the arrangement of the rows of electromagnets along the height of frame 39, reference should be had to the disposition of the perforations in the flat lower cross-member 39*a* which acts as a guiding plate for retaining rods 14. These perforations are arranged as those of the conventional paper band in a Verdol Jacquard. In such a paper band each rectangular zone or "card" corresponding to a weft thread comprises 168 transverse rows of eight possible perforations, these rows being alternately displaced in one direction and in the other in such manner as to obtain for the perforations the staggered arrangement illustrated in FIG. 6 wherein these transverse rows (which are vertical in the figure) have been referenced A to F. It results therefrom that considering the longitudinal direction (horizontal direction in FIG. 6), the flat lower cross-member comprises sixteen rows *a* to *p*, each including 84 perforations.

The perforations of the longitudinal row *a* correspond to retaining rods 14 of relatively short lenght, which are adapted to cooperate with the electromagnets of the block carried by the cross-member 43*a* which is situated at the lowermost level and on the left in FIG. 4. In FIG. 6 this block of electromagnets has been referenced 21*a*. The retaining rods 14 which pass through the second longitudinal row *b* are somewhat longer in order to cooperate with the next block 21*b* of electromagnets situated on the same side of frame 39 as block 21*a* in FIG. 4, but immediately above the latter. Owing to the staggered arrangement of the perforations in cross-member 39*a*, this block 21*b* is somewhat displaced towards the right in FIG. 6 with respect to block 21*a*, the amount of this displacement being of course equal to the displacement of the longitudinal row *b* with respect to the longitudinal row *a*.

In the same manner the retaining rods 14 of the third longitudinal row *c* cooperate with a third block 21*c* disposed above block 21*b*, but displaced with respect to the latter in such manner as to be vertically aligned with block 21*a*, and so on up to the eighth longitudinal row *h*, the retaining rods of which cooperate with the electromagnets of block 21*h* (FIG. 4).

The arrangement which corresponds to the remaining longitudinal rows of perforations *i* to *p* is exactly symmetrical with respect to rows *a* to *h* and need not therefore be described. In other words the relatively short retaining rods which correspond to the perforations of the longitudinal row *p* cooperate with the block of electromagnets 21*p* situated at the lowermost level in front of block 21*a*, on the right in FIG. 4, and so on up to the retaining rods corresponding to row *i* which cooperate with block 21*i* disposed in front of block 21*h*.

It will be observed that in FIG. 4, for a clearer understanding of the staggered arrangement of blocks 21*a* to 21*p*, those of these blocks which are displaced with respect to block 21*a* owing to the staggered arrangement of the perforations in cross-member 39*a* (namely blocks 21*b*, 21*d*, 21*f*, 21*h*, 21*j*, 21*l*, 21*n* and 21*p*) have been shown in broken lines together with the corresponding cross-members (43*b*, 43*d*, and so on).

While in the preceding description it has been supposed that the signals applied to the electromagnets 21 were generated by a photo-electric reading-in device, it is obvious that they could as well be derived from any other appropriate source, as for instance from push button switches manually actuated by a reading-in operator, or by feeler contacts when it is desired to copy an already perforated paper band.

I claim:

1. A punching machine for cards and paper bands used for the control of Jacquards, dobbies and the like, comprising:

a. multiple punches arranged to punch the cards and bands;

b. actuator means disposed to actuate said punches;

c. selector rod means connected to control the actuator means, each rod means having a portion made of magnetically attractable material and each rod means being movable between an inoperative position and an operative position in which it positions an actuator means to actuate a corresponding punch;

d. reciprocable means coupled to said rod means and operative to move them between said operative and inoperative positions; and e. retaining means corresponding with each selector rod means and selectively operable to retain the corresponding rod means in one of said positions, each retaining means comprising an electromagnet having magnetic pole means disposed adjacent to the path of the magnetically attractable portion of a corresponding selector rod means to act directly upon the rod means when the rod means is in one of said positions, the pole means being disposed such that when the electromagnet is energized said portion of the rod means will be retained by the pole means and prevented from movement to the other position of the rod means.

2. The punching machine as set forth in claim 1, wherein the pole means of each electromagnet comprises a U-shaped core having two branches with free ends which are oppositely poled when the electromagnet is energized, the free ends of said branches being disposed adjacent to and in alignment with the path of movement of the corresponding selector rod means, whereby when the rod means is in said one position its magnetically attractable portion spans said free ends.

3. The punching machine as set forth in claim 1, wherein said selector rod means are disposed parallel to each other and arranged in successive parallel rows; said electromagnets being disposed in successive parallel banks arranged transversely across said rows of rod means, the electromagnets in each bank being operatively associated with the rod means in one row; support plate means for each bank, each plate means having guiding holes receiving and guiding the rod means of that row with respect to the pole means of the corresponding electromagnets.

4. The punching machine as set forth in claim 3, wherein the pole means of each electromagnet comprises a U-shaped core having two branches with free ends which are oppositely poled when the electromagnet is energized, the free ends of said branches being disposed adjacent to and in alignment with the path of movement of the corresponding selector rod means; and each electromagnet having a single coil wound on one of the branches of its core, and the coils on successive electromagnets in a bank being wound on alternately different branches.

5. The punching machine as set forth in claim 4, wherein the electromagnets are embedded in a mass of insulating material within a casing to form in each bank an elongated unit, the free ends of the core branches of each electromagnet being exposed at the surface of said insulating material.

* * * * *